US007024879B2

(12) United States Patent
Nakatani et al.

(10) Patent No.: US 7,024,879 B2
(45) Date of Patent: Apr. 11, 2006

(54) REFRIGERATOR

(75) Inventors: Kazuo Nakatani, Osaka (JP); Yoshikazu Kawabe, Shiga (JP); Yuji Inoue, Shiga (JP); Noriho Okaza, Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 10/757,397

(22) Filed: Jan. 15, 2004

(65) Prior Publication Data

US 2004/0144120 A1 Jul. 29, 2004

(30) Foreign Application Priority Data

Jan. 16, 2003 (JP) ..... 2003-007983

(51) Int. Cl.
*F25B 13/00* (2006.01)

(52) U.S. Cl. ..... 62/324.1; 62/498

(58) Field of Classification Search ..... 62/324.1–6, 62/498, 324.6; 417/243, 251; 418/7, 8, 418/60, 83
See application file for complete search history.

(56) References Cited

U.S. PATENT DOCUMENTS

| | | | | |
|---|---|---|---|---|
| 3,859,815 | A | 1/1975 | Kasahara | 62/197 |
| 4,326,868 | A * | 4/1982 | Ozu et al. | 62/324.6 |
| 5,062,274 | A | 11/1991 | Shaw | 62/117 |
| 6,584,796 | B1 * | 7/2003 | Itoh et al. | 62/324.1 |

FOREIGN PATENT DOCUMENTS

| | | |
|---|---|---|
| EP | 41 27 754 A1 | 2/1993 |
| EP | 1 033 541 A1 | 9/2000 |
| JP | 1-239350 | 9/1989 |
| JP | 5-288421 | 11/1993 |
| JP | 11-63694 | 3/1999 |
| JP | 2001-41598 | 2/2001 |
| JP | 2001-133057 | 5/2001 |
| JP | 2001-296067 | 10/2001 |
| JP | 2003-74990 | 3/2003 |
| JP | 2003-74997 | 3/2003 |
| JP | 2003-262414 | 9/2003 |

OTHER PUBLICATIONS

European Search Report dated May 11, 2004.
Huff H-J et al: "Options for a Two-Stage Transcriptional Carbon Dioxide Cycle" IIR Gustav Lorentzen Conference on Natural Working Fluids. Joint Conference of the International Institute of Refrigeration Section B and E, XX, XX, Sep. 17, 2002, pp. 158-164, XP001176579 *abstract*.
Lorentzen G: "revival of carbon dioxide as a refrigerant" International Journal of Refrigeration, Oxford, GB, vol. 17, No. 5, Jun. 1, 1994, pp. 292-301, XP000444432 ISSN: 0140-7007 *abstract*.

* cited by examiner

*Primary Examiner*—Melvin Jones
(74) *Attorney, Agent, or Firm*—Armstrong, Kratz, Quintos, Hanson & Brooks, LLP

(57) ABSTRACT

In the case of gas injection, a discharging temperature is not reduced sufficiently, and if an amount of injection is increased, a liquid refrigerant flows into a cylinder and the liquid is compressed, and the reliability can not be ensured.

A refrigerator wherein at least a compressor, a radiator, a first throttle apparatus and an evaporator are connected to one another in an annular form to constitute a main circuit of a refrigeration cycle, a refrigerant which can be brought into a supercritical state by the radiator during operation is charged into the refrigeration cycle, the refrigerator comprises an injection pipe for injecting the refrigerant on the side of an outlet of the radiator into a cylinder of the compressor.

5 Claims, 3 Drawing Sheets

REFRIGERATOR

TECHNICAL FIELD

The present invention relates a refrigerator used in an air conditioner or the like.

BACKGROUND TECHNIQUE

FIG. 4 shows a conventional refrigerator (see Patent Document 1 for example). In FIG. 4, a reference number 1 represents a compressor, a reference number 2 represents an outdoor heat exchanger, a reference number 3 represents an indoor heat exchanger, a reference number 4 represents an accumulator and a reference number 5 represents a four-way valve, The outdoor heat exchanger 2 and the indoor heat exchanger 3 are connected to each other through a refrigerant passage 17. A refrigerant passage 17 is provided with the first expansion valve 11, the second expansion valve 12 and a third, expansion valve 13 in series.

The refrigerant passage 17 between the first expansion valve 11, and the second expansion valve 12 is provided with a receiver 7 for separating gas and liquid from each other. An inner heat exchanger 8 includes a high pressure-side heat transfer section 8*a* and a low pressure-side heat transfer section 8*b*. The refrigerant passage 17 between a second expansion valve 12 and a third expansion valve 13 is provided with the high pressure-side heat transfer section 8*a* of the inner heat exchanger 8. One end of the low pressure-side heat transfer section 8*b* of the inner heat exchanger 8 is connected to a refrigerant passage 14 and the other end of the low pressure-side heat transfer section 8*b* is connected to a refrigerant passage 15. The refrigerant passage 14 is an outlet-side pipe of the four-way valve 5, and the refrigerant passage 15 is an inlet-side pipe to the accumulator 4. A gas phase section of the receiver 7 is connected to a compressing chamber of the compressor 1 through a refrigerant passage 16 including a control valve 10. This conventional refrigerator uses carbon dioxide as a refrigerant.

A cooling operation of the refrigerator will be explained with reference to FIG. 5 which is a diagram showing "P(pressure)-h(enthalpy)".

At the time of the cooling operation, CO2 refrigerant (gas refrigerant) discharged from the compressor 1 is introduced into the outdoor heat exchanger 2 through the four-way valve 5, and heat of the refrigerant is dissipated at a supercritical region (regions of points D to E in FIG. 5) in the outdoor heat exchanger 2. The CO2 refrigerant In a supercritical state flowing out from the outdoor heat exchanger 2 is primarily expanded in the first expansion valve 11 (regions of points E to F). and introduced into the receiver 7 in a gas-liquid two phases, and gas and liquid are separated here (points G and H).

A liquid refrigerant separated in the receiver 7 passes through the fully-opened second expansion valve 12 and flows into the high pressure-side heat transfer section 8*a* of the inner heat exchanger 8. While the liquid refrigerant flows from an inlet (point H) of the high pressure-side heat transfer section 8*a* toward an outlet (point I) of the high pressure-side heat transfer section 8*a*, the liquid refrigerant exchanges heat between itself and gas refrigerant which flows from an inlet (point K) of the low pressure-side heat transfer section 8*b* toward an outlet (point A) of the low pressure-side heat transfer section 8*b*. Then, the liquid refrigerant is secondarily expanded in the third expansion valve 13 (regions of points I to J). Thereafter, the liquid refrigerant is sent to the indoor heat exchanger 3 and is evaporated while it flows from an inlet (point J) of the indoor heat exchanger 3 to an outlet (point K) of the indoor heat exchanger 3 and becomes gas refrigerant. This gas refrigerant is again drawn into the compressor 1 and compressed. The drawing temperature is higher (i.e., temperature corresponding to point A) than the outlet temperature (temperature corresponding to point K) of the indoor heat exchanger 3 by a temperature (shown with "d") increased by the internal heat exchange in the inner heat exchanger 8. The gas refrigerant separated by the receiver 7 is injected into the compressing chamber which is in a compression stroke of the compressor 1 through the refrigerant passage 16 (see point G).

The gas refrigerant is injected into the compressing chamber of the compressor 1 in this manner, and the gas refrigerant is mixed with a gas refrigerant in the compressing chamber, thereby facilitating the cooling effect and high density effect of the gas refrigerant in the compressing chamber. Therefore, the drawing temperature of the compressor 1 is increased by the internal heat exchange, and a temperature of the gas refrigerant in the compressing chamber is once reduced to a temperature corresponding to point C from a temperature corresponding to point B at the time of gas injection irrespective of a fact that the compression is started from this high drawing temperature, and the reduced temperature is again increased and the temperature corresponding to point D becomes a discharging temperature. Therefore, since the discharging temperature is affected by temperature reduction associated with the gas Injection, and the discharging temperature can be lower than a temperature (temperature corresponding to point D0) when the gas injection is not carried out and the refrigerant is compressed from point A to point D0, and the reliability of the compressor 1 can be enhanced.

[Patent Document 1]

Japanese Patent Application Laid-open No. 2001-296067 (page 8, FIGS. 4 and 5)

According to this conventional refrigerator, when a compression ratio of the compressor 1, i.e., a ratio of a discharging pressure at point D and a drawing pressure at point A shown in FIG. 5 is great at the time of warming operation for example when an outside temperature is low, the discharging temperature becomes abnormally high due to characteristics of the carbon dioxide which is a refrigerant. For this reason, even if a gas refrigerant separated by the receiver 7 is injected into the compressor 1, the discharging temperature is not lowered sufficiently and the reliability of the compressor 1 is not sufficient.

To avoid this situation, if the control valve 10 is further opened to:increase the amount of injection flow of the refrigerant, a liquid refrigerant separated in the receiver 7 is also injected. Therefore, the liquid refrigerant flows into the compressing chamber which is in the compression stroke of the compressor 1, and the incompressible liquid refrigerant is compressed. Thus, a cylinder, a bearing and the like which form the compressing chamber are worn, and reliability thereof can not be secured.

DISCLOSURE OF THE INVENTION

The present invention has been accomplished to solve the conventional problem, and it is an object of the invention to provide a refrigerator in which even if carbon dioxide is used as a refrigerant and the refrigerator is operated at high compression ratio, a discharging temperature of the compressor can reliably and safely be reduced.

To solve the above conventional problem, the refrigerator of the invention comprises an injection pipe for injecting a refrigerant in a supercritical state of a radiator outlet into a cylinder of a compressor. Since the refrigerant in the supercritical state having low enthalpy which is discharged from the radiator is directly injected into the compressor, even if the amount of refrigerant is small, the effect for reducing a discharging temperature of the compressor is great. Further, not a liquid refrigerant but the refrigerant in the supercritical state is injected and thus, liquid compression is not carried out and the reliability is enhanced.

Further, according to the present invention, even when cooling and warming operations are carried out by switching a four-way valve, since the refrigerant in the supercritical state of an outlet of an outdoor heat exchanger or an outlet of an indoor heat exchanger is injected into the cylinder of the compressor using a check valve, the refrigerant in the supercritical state having the low enthalpy can directly be injected to the compressor, the discharging temperature of the compressor can largely be reduced. Since the refrigerant is in the supercritical state, liquid compression is not carried out and the reliability is enhanced.

PREFERRED EMBODIMENTS OF THE PRESENT INVENTION

A refrigerator of the present invention will be explained based on concrete embodiments below.

(Embodiment 1)

Figure 1:
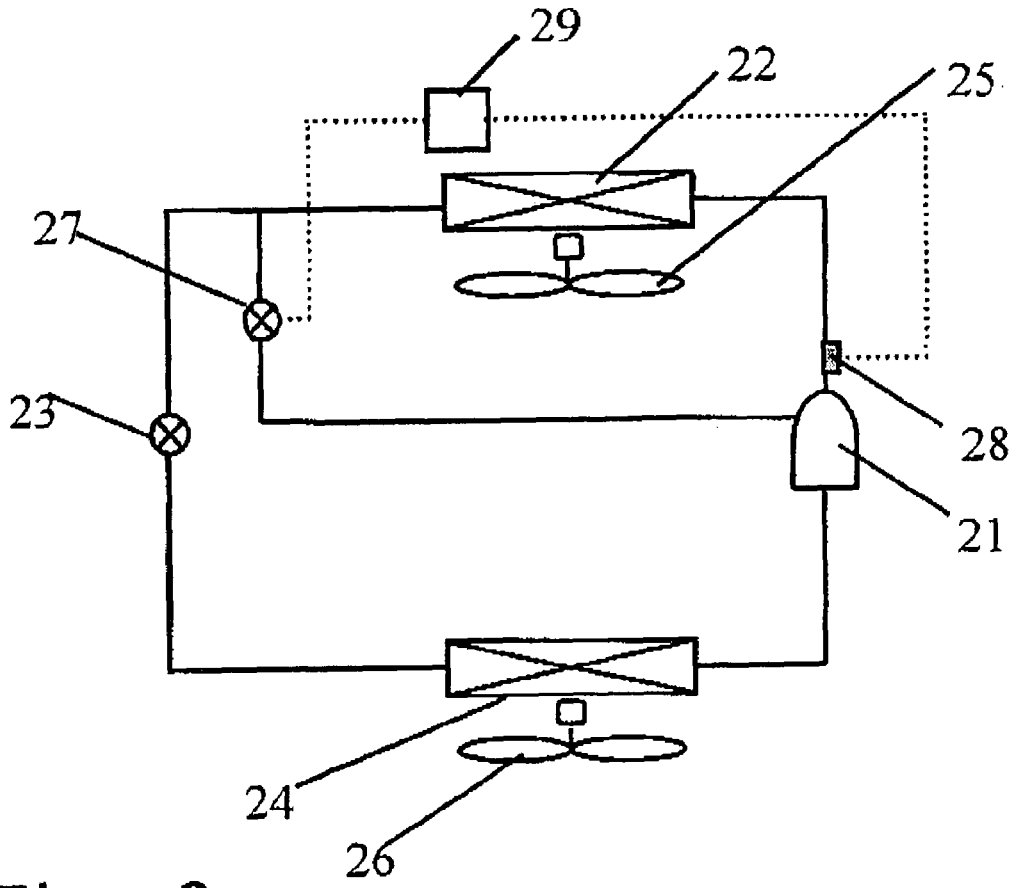
FIG. 1 is a block diagram of a refrigerator according to an embodiment 1 of the present invention.

FIG. 1 is a block diagram of a refrigerator according to an embodiment 1 of the present invention.

In FIG. 1, a reference number 21 represents a compressor, a reference number 22 represents a radiator, a reference number 23 represents a first throttle apparatus and a reference number 24 represents an evaporator. A reference number 25 represents a fan for the radiator 22 and a reference number 26 represents a fan for the evaporator 24. In this refrigerator, a pipe which is branched off from a pipe on the side of an outlet of the radiator 22 is connected to a cylinder (not shown) of the compressor 21, and a second throttle apparatus 27 is provided in an intermediate portion of the branched pipe, and a refrigerant on the side of the outlet of the radiator 22 is injected into the cylinder of the compressor 21.

A temperature sensor 28 detects a discharged gas temperature of the compressor 21. A control apparatus 29 compares the discharged gas temperature and a set value and controls an opening degree of the second throttle apparatus 27.

In this embodiment, the refrigerator uses carbon dioxide as the refrigerant.

Figure 2:
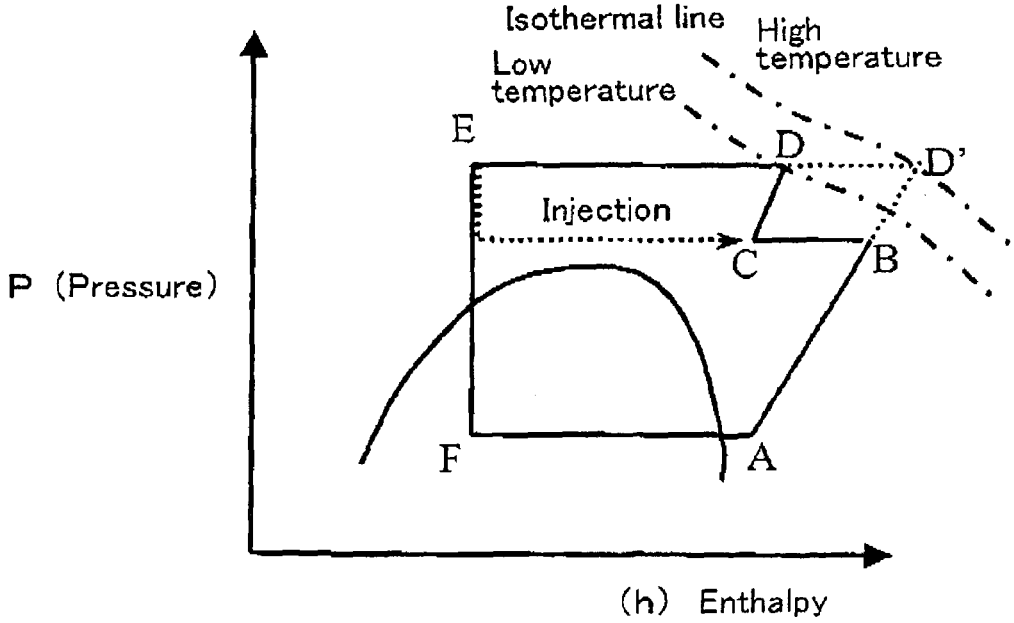
FIG. 2 is a P-h diagram showing a refrigeration cycle in the embodiment of the invention.

The operation of the refrigerator will be explained with reference to FIG. 2 also. FIG. 2 is a "P(pressure)-h(enthalpy) diagram".

A refrigerant (carbon dioxide) is compressed to a high pressure and discharged by the compressor 21. The discharged refrigerant is introduced into the radiator 22, heat thereof is exchanged with air by the fan 25, and the heat is dissipated in a supercritical region (region of points D to E in FIG. 2). The carbon dioxide refrigerant in the supercritical state flowing out from the radiator 22 is expanded by the first throttle apparatus 23 (regions of points E and F). The carbon dioxide refrigerant is heat-exchanged with air by the fan 26 and is evaporated and becomes a gas refrigerant (regions of points F to A).

The gas refrigerant is again drawn into the compressor 21 (point A) and compressed.

On the other hand, when the discharged gas temperature of the compressor 21 detected by the temperature sensor 28 is higher than a temperature preset in the control apparatus 29, the control apparatus 29 outputs a command for increasing an opening degree of the second throttle apparatus 27 so that refrigerant flows.

In this case, a portion of the refrigerant in the supercritical state flowing out from the radiator 22 (point E) passes through the second throttle apparatus 27 and is injected into the cylinder of the compressor 21.

Then, the drawn gas compressed in the cylinder (point A) is compressed up to point B where the drawn gas is mixed with the injected refrigerant, a temperature thereof is reduced to the state of point C, and the drawn gas is further compressed and brought into a high pressure state (point D).

In this embodiment, since a refrigerant in the supercritical state at point E having low enthalpy is directly injected, the state of point D can largely be reduced in temperature as compared with a discharged gas temperature when the refrigerant is not injected (point D'), and it is possible to prevent the reliability of the compressor 21 from being deteriorated due to temperature rise.

Since the injected refrigerant in the supercritical state is not a liquid refrigerant, it has compressibility. That is, if a liquid refrigerant having a temperature of 20° C. and a pressure of 6 MPa is adiabatic-compressed and its pressure becomes 30 MPa in supercritical state, its density is increased only by about 10% and it is not compressed almost at all. However, if a carbon dioxide refrigerant in the supercritical state having a temperature of 35° C. and a pressure of 8 MPa is adiabatic-compressed to 30 MPa, its density is increased by about 60%, and its compressibility is great.

For this reason, even if a large amount of refrigerant in the supercritical state is temporarily injected and mixed into the cylinder or bearing, an abnormal pressure rise by capacity reduction of the cylinder or bearing is less prone to be generated, and various sliding parts in the compressor 21 can be prevented from being worn and thus, the reliability is enhanced.

In this embodiment, the opening degree of the second throttle apparatus 27 is controlled in association with a difference between a discharged gas temperature of the compressor 21 detected by the temperature sensor 28 and a temperature which is preset in the control apparatus 29. Alternatively, high pressure and low pressure may be detected and the opening degree of the second throttle apparatus 27 may be controlled in association with the pressures. Such a method is also one of embodiments of this invention.

(Embodiment 2)

Figure 3:
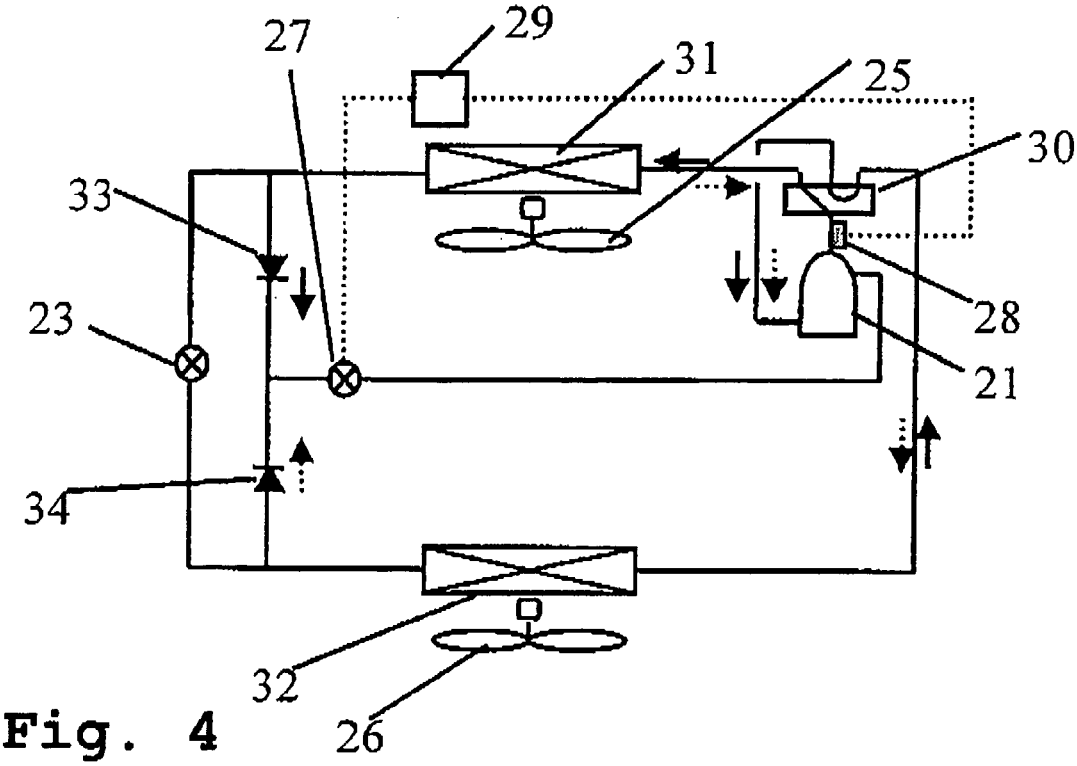
FIG. 3 is a block diagram of a refrigerator according to an embodiment 2 of the invention.
Figure 4:
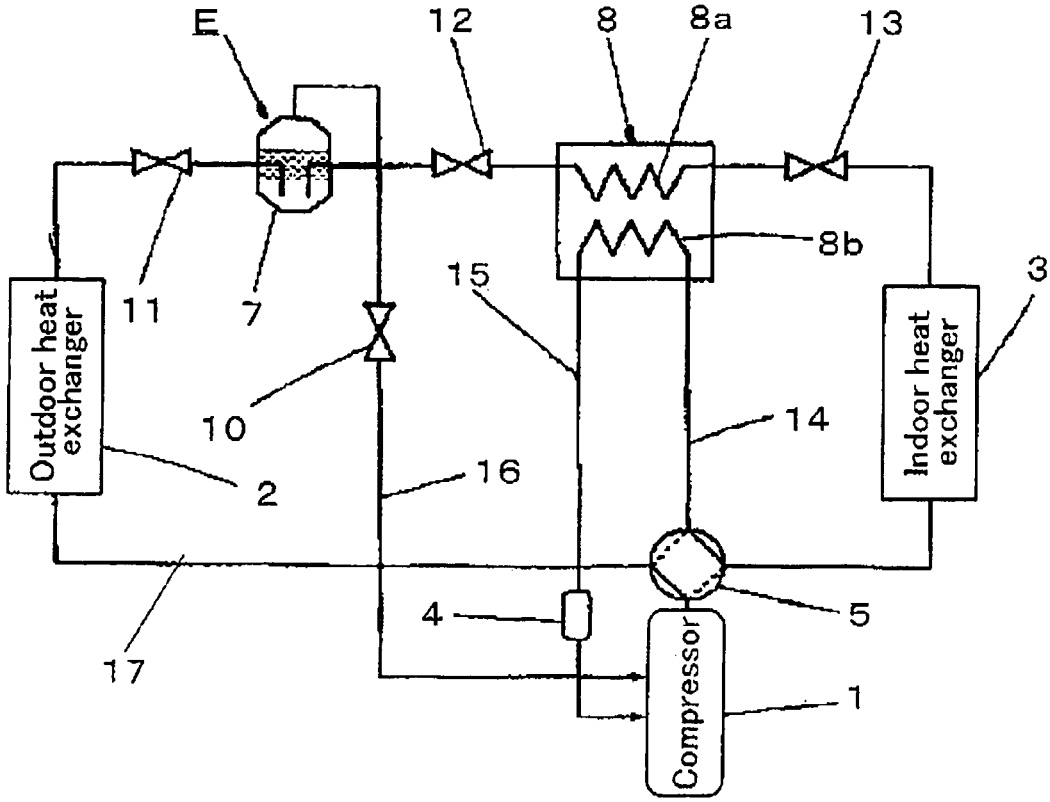
FIG. 4 is a block diagram of a conventional refrigerator.
Figure 5:
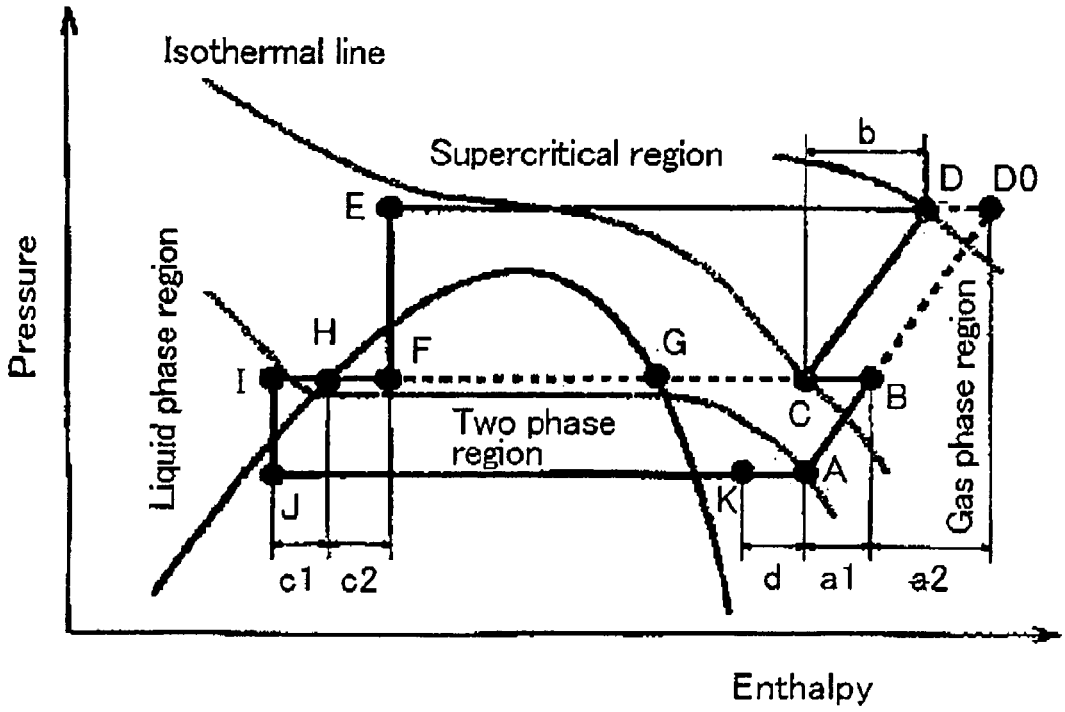
FIG. 5 is a P-h diagram showing a refrigeration cycle of the conventional refrigerator.

FIG. 3 is a block diagram of a refrigerator in an embodiment 2 of the present invention.

In FIG. 3, elements having the same functions as those shown in FIG. 1 are designated with the same symbols and explanation thereof will be omitted.

The refrigerator in the embodiment 2 includes a four-way valve 30 which switches cooling and warming operations, an outdoor heat exchanger 31, a first throttle apparatus 23 and an indoor heat exchanger 32 are connected to one another to constitute a main circuit of the refrigeration cycle.

A pipe branched off from a pipe between the outdoor heat exchanger 31 and the first throttle apparatus 23 is connected to a cylinder (not shown) of the compressor 21, and a check valve 33 is connected to an intermediate portion of the branched pipe so that a refrigerant only flows toward the compressor 21 (in a direction shown with solid arrows in FIG. 3). A pipe branched off from a pipe between the indoor heat exchanger 32 and the first throttle apparatus 23 is connected to the cylinder (not shown) of the compressor 21, and a check valve 34 is connected to an intermediate portion of the branched pipe so that a refrigerant only flows toward the compressor 21 (in a direction shown with broken arrows in FIG. 3).

The pipe on the side of an outlet of the check valve 33 and the pipe on the side of an outlet of the check valve 34 are merged with each other as a common pipe, and this common pipe is connected to a second throttle apparatus 27.

According to the refrigerator of this embodiment, a refrigerant between the outdoor heat exchanger 31 and the first throttle apparatus 23 is injected into the cylinder of the compressor 21 at the time of the cooling operation, and a refrigerant between the indoor heat exchanger 32 and the first throttle apparatus 23 is injected into the cylinder of the compressor 21 at the time of warming operation.

In this embodiment, the refrigerator uses carbon dioxide as the refrigerant.

The operation of this refrigerator will be explained also using FIG. 2 explained in the embodiment 1. FIG. 2 is a "P(pressure)-h(enthalpy) diagram".

At the time of the cooling operation, a refrigerant (carbon dioxide) which was compressed to a high pressure and discharged by the compressor 21 passes through the four-way valve 30 and flows in the direction shown with solid arrows and is introduced into the outdoor heat exchanger 31. Heat of the refrigerant is exchanged with outdoor air sent by the fan 25 and dissipated in the supercritical region (regions of points D to E in FIG. 2). The carbon dioxide refrigerant in the supercritical state flowing out from the outdoor heat exchanger 31 is expanded in the first throttle apparatus 23 (regions of points E to F), and heat of the refrigerant is exchanged with indoor air sent by the fan 26 in the indoor heat exchanger 32 to carry out the cooling operation. The refrigerant is evaporated and becomes a gas refrigerant (regions of points F to A).

The gas refrigerant passes through the four-way valve 30 and is again drawn into the compressor 21 (point A) and compressed.

When the second throttle apparatus 27 is closed due to directional properties of the check valves 33 and 34, the refrigerant does not flow such as to bypass the first throttle apparatus 23.

On the other hand, when the discharged gas temperature of the compressor 21 detected by the temperature sensor 28 is higher than a temperature preset in the control apparatus 29, the control apparatus 29 outputs a command for increasing an opening degree of the second throttle apparatus 27 so that refrigerant flows.

In this case, a portion of the refrigerant in the supercritical state flowing out from the outdoor heat exchanger 31 (point E) passes through the check valve 33 and the second throttle apparatus 27 and is injected into the cylinder of the compressor 21.

Then, the drawn gas compressed in the cylinder (point A) is compressed up to point B where the drawn gas is mixed with the injected refrigerant, a temperature thereof is reduced to the state of point C, and the drawn gas is further compressed and brought into a high pressure state (point D).

In this embodiment, since a refrigerant in the supercritical state at point E having low enthalpy is directly injected, the state of point D can largely be reduced in temperature as compared with a discharged gas temperature when the refrigerant is not injected (point D'), and it is possible to prevent the reliability of the compressor 21 from being deteriorated due to temperature rise.

Since the injected refrigerant in the supercritical state is not a liquid refrigerant, it has compressibility. For this reason, even if a large amount of refrigerant in the supercritical state is temporarily injected and mixed into the cylinder or bearing, an abnormal pressure rise by capacity reduction of the cylinder or bearing is less prone to be generated, and various sliding parts in the compressor 21 can be prevented from being worn and thus, the reliability is enhanced.

On the other hand, at the time of the warming operation, a refrigerant (carbon dioxide) which was compressed to a high pressure and discharged by the compressor 21 passes through the four-way valve 30 and flows in the direction shown with broken arrows and is introduced into the indoor heat exchanger 32. Heat of the refrigerant is exchanged with indoor air sent by the fan 26 to carry out the warming operation and dissipated in the supercritical region (regions of points D to E in FIG. 2). The carbon dioxide refrigerant in the supercritical state flowing out from the indoor heat exchanger 32 is expanded in the first throttle apparatus 23 (regions of points E to F), and heat of the refrigerant is exchanged with outdoor air sent by the fan 25 in the outdoor heat exchanger 31. The refrigerant is evaporated and becomes a gas refrigerant (regions of points F to A).

The gas refrigerant passes through the four-way valve 30 and is again drawn into the compressor 21 (point A) and compressed.

When the second throttle apparatus 27 is closed due to directional properties of the check valves 33 and 34, the refrigerant does not flow such as to bypass the first throttle apparatus 23.

On the other hand, when the discharged gas temperature of the compressor 21 detected by the temperature sensor 28 is higher than a temperature preset in the control apparatus 29, the control apparatus 29 outputs a command for increasing an opening degree of the second throttle apparatus 27 so that refrigerant flows.

In this case, a portion of the refrigerant in the supercritical state flowing out from the indoor heat exchanger 32 passes (point E) through the check valve 34 and the second throttle apparatus 27 and is injected into the cylinder of the compressor 21.

The "P(pressure)-h(enthalpy) diagram" showing the state of the refrigerant of this case is the same as that of the cooling operation and thus, explanation thereof is omitted.

In this case, when high temperature wind is necessary such as warming operation when outside temperature is low, the discharging pressure is increased, the drawing pressure is reduced and the discharging temperature is abnormally increased. Therefore, the discharging temperature can reliably be reduced by the present invention and various sliding parts in the compressor 21 can be prevented from being worn and thus, the reliability is enhanced.

In this embodiment, at the time of the cooling and warming operations, the opening degree of the second throttle apparatus 27 is controlled in association with a difference between a discharged gas temperature of the compressor 21 detected by the temperature sensor 28 and a temperature which is preset in the control apparatus 29. Alternatively, high pressure and low pressure may be detected and the opening degree of the second throttle apparatus 27 may be controlled in association with the pressures. Such a method is also one of embodiments of this invention.

As explained above, according to the refrigerator of the present invention, since the refrigerant in the supercritical state is directly injected to the compressor, even if the amount of the refrigerant is small, the effect for reducing the discharging temperature is great, and since the refrigerant in the supercritical state has higher compressibility than that of the liquid refrigerant, even if the refrigerant in the supercritical state is mixed into the cylinder or bearing, the pressure is less prone to be increased abnormally unlike the conventional liquid compression, various sliding parts can be prevented from being worn, and the reliability can be enhanced.

What is claimed is:

1. A refrigerator wherein at least a compressor, a radiator, a first throttle apparatus and an evaporator are connected to one another to constitute a main circuit of a refrigeration cycle, a refrigerant which can be brought into a supercritical state by said radiator during operation is charged into said refrigeration cycle, an injection pipe branched off from a pipe between an outlet of said radiator and an inlet of said first throttle apparatus is connected to a cylinder of said compressor not via a receiver for separating gas and liquid from each other, and the refrigerant in the supercritical state is injected into said cylinder of said compressor.

2. The refrigerator according to claim 1, wherein a second throttle apparatus is provided in an intermediate portion of said injection pipe, and when a discharging temperature of said compressor exceeds a predetermined value, said second throttle apparatus is opened.

3. A refrigerator wherein at least a compressor, a four-way valve, an outdoor heat exchanger, a first throttle apparatus and an indoor heat exchanger are used as constituent elements for constituting a main circuit of a refrigeration cycle, a refrigerant which can be brought into a supercritical state by said outdoor heat exchanger or said indoor heat exchanger during operation is charged into said refrigeration cycle, a pipe branched off from a pipe between said outdoor heat exchanger and said first throttle apparatus not via a receiver for separating gas and liquid from each other is provided with a first check valve, a pipe branched off from a pipe between said indoor heat exchanger and said first throttle apparatus not via a receiver for separating gas and liquid from each other is provided with a second check valve, a downstream pipe of said first check valve and a downstream pipe of said second check valve are merged with each other and connected to a cylinder of said compressor, said first check valve and said second check valve are provided such that the refrigerant only flows toward said cylinder of said compressor, the refrigerant in the supercritical state is injected into said cylinder of said compressor from said pipe between said outdoor heat exchanger and said first throttle apparatus or said pipe between said indoor heat exchanger and said first throttle apparatus.

4. The refrigerator according to claim 3, wherein a second throttle apparatus is provided in a pipe between said cylinder of said compressor and the merging point between said downstream pipe of said first check valve and said downstream pipe of said second check valve, and when a discharging temperature of said compressor exceeds a predetermined value, said second throttle apparatus is opened.

5. The refrigerator according to any one of claims 1 to 4, wherein carbon dioxide is used as the refrigerant.

* * * * *